US005237924A

United States Patent [19]

Fujino et al.

[11] Patent Number: 5,237,924

[45] Date of Patent: Aug. 24, 1993

[54] METHOD OF PRINTING ON WORKPIECES OF DIFFERING THICKNESSES

[75] Inventors: Noboru Fujino; Tohru Takamura, both of Tokyo, Japan

[73] Assignee: Kabushiki Kaisha Shinkawa, Tokyo, Japan

[21] Appl. No.: 957,626

[22] Filed: Oct. 6, 1992

Related U.S. Application Data

[63] Continuation of Ser. No. 621,283, Nov. 30, 1990, abandoned.

[51] Int. Cl.[5] ..... B41F 1/54

[52] U.S. Cl. ..... 101/484; 101/316

[58] Field of Search ..... 101/287, 290, 93.01, 101/93.03, 93.37, 93.47, 293, 316, 317, 318, 322, 193, 3.1, 4.41, 42, 164, 198, 290, 292, 484, 485, 486; 400/55, 56, 57

[56] References Cited

U.S. PATENT DOCUMENTS

| | | | |
|---|---|---|---|
| 4,029,010 | 6/1977 | Deisting | 101/316 |
| 4,493,253 | 1/1985 | Vyas | 101/93.03 |
| 4,652,153 | 3/1987 | Kotsuzumi | 400/56 |
| 4,949,098 | 8/1990 | Gluck et al. | 400/56 X |

*Primary Examiner*—J. Reed Fisher

*Attorney, Agent, or Firm*—Koda and Androlia

[57] ABSTRACT

In a marking method and apparatus which uses relief-plate printing, the distance between printing plate and surface of a workpiece is calculated based upon a rotational position of a vertical direction driving motor before the lowering of the printing plate and a rotational position of the vertical direction driving motor at the time the printing plate comes into contact with the workpiece and signal is accordingly generated by a detector. Thus, the distance between the printing plate and the surface of the workpiece can be easily calculated, and even if the workpieces are not the same in thickness, the amount the plate holder is lowered can be set easily and in a short period of time.

1 Claim, 2 Drawing Sheets

METHOD OF PRINTING ON WORKPIECES OF DIFFERING THICKNESSES

This is a continuation of application Ser. No. 621,283, filed Nov. 30, 1990, now abandoned.

BACKGROUND OF THE INVENTION

1. Field of the Invention

The present invention relates to a marking method and apparatus which uses relief-plate printing.

2. Prior Art

In conventional marking devices, as shown in FIG. 4, a printing plate 50 is attached to a plate holder 51. The plate holder 51 is fixed to an oscillating lever 63 that is pivoted up and down via a cam 52. A spring 55 pulls the lever 53 downward so that the lever 53 pivots along the surface of the cam 52. Reference numeral 56 is a workpiece to be printed which is positioned and carried on a workpiece carrying table 57.

Since the plate holder 51 is driven by the cam 52, the distance the printing plate 50 is lowered is fixed. Accordingly, when the thickness of the workpiece 56 changes (due to the difference in the type of work performed), the distance between the printing plate 50 and the workpiece 56 must be adjusted by loosening the screw 54 and moving the plate holder 51 up and down.

The adjustment of the distance is performed as follows: after printing is performed, the condition of such a printing (i.e., the condition of contact of the printing plate 50 to workpiece 56) is examined, and then the height of the plate holder 51 is adjusted. Thus, considerable adjustment time is required. Since the condition of contact of the printing plate 50 with the printing surface of the workpiece varies depending upon the operator doing the adjustment job, uniform printing cannot be achieved.

SUMMARY OF THE INVENTION

The object of the present invention is to provide a marking method and apparatus which allows easy setting of the distance between the printing plate (at the point where the lowering of the plate holder is started) and the workpiece, so that uniform printing is achieved.

The marking method of the present invention is characterized in that (a) a plate holder to which a printing plate is attached is moved up and down by a Z-direction driving motor, (b) a detection means detects whether or not the printing plate contacts the workpiece, and (c) the distance between the printing plate and the top surface of the workpiece before the plate holder is lowered is calculated based upon the position where the lowering of the plate holder is started and the position where the printing plate contacts the workpiece.

On the other hand, the marking apparatus of the present invention includes (a) a plate holder to which a printing plate is attached, (b) a moving table which supports the plate holder so that the plate holder is free to move up and down and that the plate holder moves up and down following the moving table, (c) a Z-direction (vertical direction) driving motor which drives the moving table in the Z-direction, and (d) a detection means that detects the point at which the plate holder no longer follows the moving table when the printing plate contacts the workpiece.

According to the present invention, the distance between the printing plate and the surface of the workpiece is calculated on the basis of (a) the rotational position of the Z-direction driving motor prior to the lowering of the printing plate and (b) the rotational position of the Z-direction driving motor during the time that a signal is generated by the detection means when the printing plate contacts the workpiece. Accordingly, even if workpieces of different thickness are processed by the apparatus, the distant the plate holder is lowered can be set in a simple manner and in a short period of time. The condition of contact of the printing plate with the surface of the workpiece does not vary depending upon the worker performing the adjustment. In this way, uniform printing can be achieved.

DETAILED DESCRIPTION OF THE INVENTION

One embodiment of the present invention will be described with reference to FIGS. 1 and 2.

Figure 1:
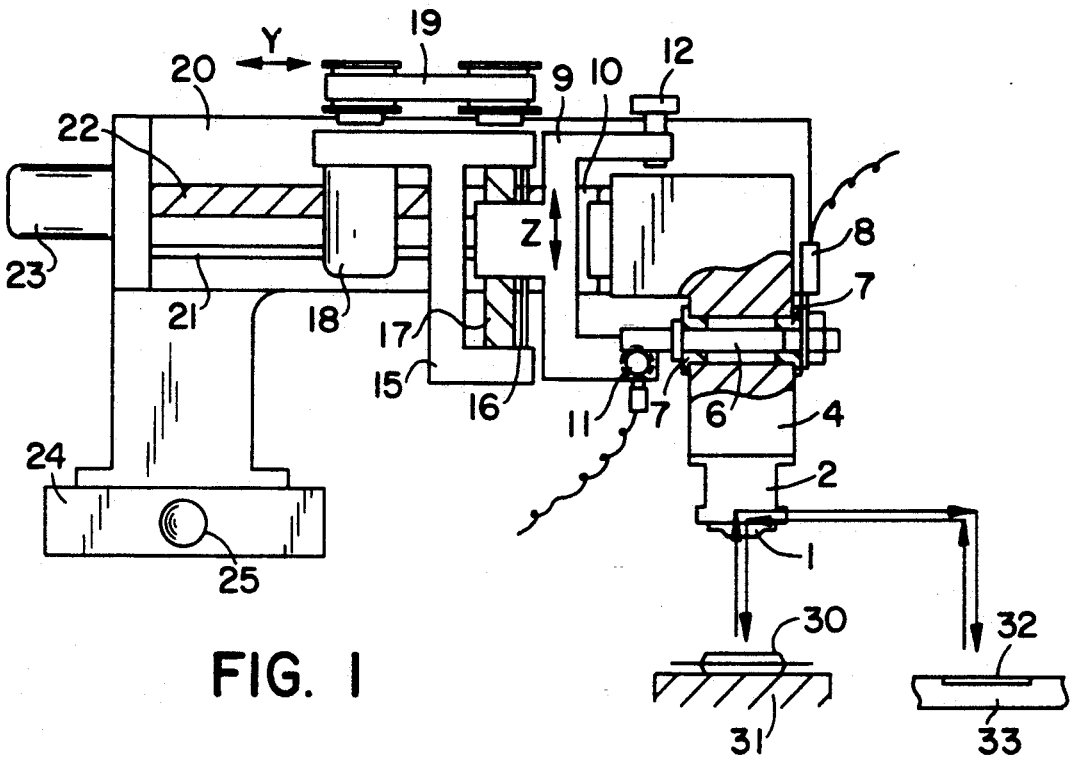
FIG. 1 is a front view which illustrates the device in accordance with the present invention.

As shown in FIG. 1, a printing plate (rubber stamp) 1 is attached to a plate holder 2 which is detachably mounted to a plate holder attachment 4.

A contact rod 6 made of an electrically conductive material is fastened to the plate holder attachment 4 through an insulator 7. At one end of this contact rod 6, an electrical terminal 8 is connected. The plate holder attachment 4 is installed on a first moving table 9 via a linear guide 10 so that the plate holder attachment 4 is free to move up and down.

A contact rod 11 is fastened to the lower end of the first moving table 9. The contact rod 11 is made of an electrically conductive material and supports the undersurface of the contact rod 6. A stopper 12 is screwed to the upper end of the first moving table 9 so as to face the upper surface of the plate holder attachment 4.

Accordingly, when the first moving table 9 moves up and down, the plate holder attachment 4 is also caused to move up and down via the contact rods 11 and 6. The stopper 12 is adjusted so that a gap of approximately 50 microns remains between the stopper 12 and the plate holder attachment 4 when the contact rods 6 and 11 are in contact with each other. The contact rod 11 is connected to a ground line.

The first moving table 9 slides on a guide rod 16 which is installed uprightly on a second moving table 15. The first moving table 9 is engaged with a Z-direction feed screw 17 which is supported to the guide rod 16 of the second moving table 15 so that the feed screw 17 is free to rotate.

The Z-direction feed screw 17 is driven via a belt 19 by a Z-direction driving motor 18 which is fixed to the second moving table 15. The second moving table 15 can slide on a guide rod 21 which is installed in the horizontal Y direction on a third moving table 20. The second moving table 15 is engaged with a Y-direction feed screw 22 that is parallel to the guide roll 21 and is rotatable by the third moving table 20. The Y-direction feed screw 22 is driven by a Y-direction driving motor 23 which is mounted to the third moving table 20.

Third moving table 20 in installed on a base 24 so that the table 20 can slide in the horizontal X direction. The third moving table 20 is driven, via an X-direction feed screw (not shown), by an X-direction driving motor 25 fixed to base 24.

When the Z-direction driving motor 18 is driven, the Z-direction feed screw 17 is caused to rotate via the belt 19. Accordingly, the first moving table 9 is moved in the Z direction, and the plate holder 2 is moved in the Z direction along with the plate holder attachment 4.

When the Y-direction driving motor 23 is driven, the second moving table 15 is moved in the X direction by the Y-direction feed screw 22. Thus, the plate holder 2 is also caused to move in the Y direction.

Similarly, when the X-direction driving motor 25 is driven, the third moving table 20 is moved in the X direction. Thus, the plate holder 2 is caused to move in the X direction.

An ink stand 33 containing ink 32 is installed away, in the Y direction, from workpiece carrying table 31 on which the workpiece 30 upon which printing is performed is positioned and carried.

With the structure described above, printing is performed by repeating an action (indicated by the arrows shown in the lower right hand corner of FIG. 1) in which the ink 32 is applied to the printing plate 1, and then the workpiece 30 is printed. Such an action is accomplished by a combination of (a) the movements of the plate holder 2 in the Z direction (driven by the Z-direction driving motor 18) and (b) the movements of the plate holder 2 in the X direction (driven by the X-direction driving motor 25).

Figure 2:
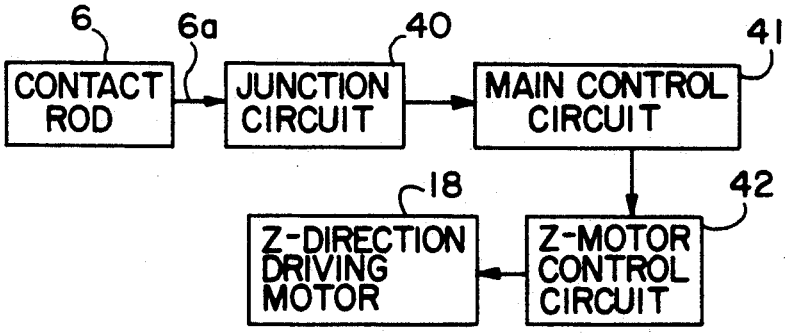
FIG. 2 is a circuit diagram of the device of FIG. 1.

As shown in FIG. 2, signal 6a generated by the contact rod 6 when the contact rod 11 is separated from the contact rod 6 is inputted into a main control circuit 41 via a junction circuit 40. The main control circuit 41 controls the motors 5, 18, 23 and 25 and controls the feeding of the workpiece 30. In other words, when the signal 6a from the contact rod 6 is inputted, a signal which controls the Z-direction driving motor 18 via Z-motor control circuit 42 is outputted.

Before the printing operation is described, the method for setting the distance between the printing plate 1 and the workpiece 30 will be explained.

After the printing plate 1 is positioned above the workpiece 30, the Z-direction driving motor 18 is driven so that the plate holder 2 is lowered. The positional information of the printing plate 1 before the start of this lowering action is stored beforehand in the main control circuit 41. The position of the printing plate 1 can easily be ascertained if an encoder-equipped motor is used as the Z-direction driving motor 18.

The lowering operation of the plate holder 2 is performed by an operator manually. A universally known electrical chessman (not shown) can be used in this operation so that the Z-direction driving motor 18 is driven one pulse at a time.

When the first moving table 9 is further lowered after the printing plate 1 has contacted the workpiece 30, the contact rod 6 is lowered along with the contact rod 11 lowered (while being kept in contact with the contact rod 11) until the printing plate is compressed by the weights of the plate holder attachment 4 and elements 1 through 3 and 5 through 8.

After this, the plate holder attachment 4 is no longer lowered, and only the first moving table 9 continues to be lowered. As a result, the contact rod 11 is separated from the contact rod 6, and an "off" signal 6a is outputted from the contact rod 6.

The amount of distance of compression of the printing plate 1 mentioned above varies depending upon the material of the printing plate 1. Ordinarily, it is approximately 50 microns. Taking this value into consideration, the position 50 microns above the detection point is designated as a "Z level" which is the distance from there to the top surface of the workpiece 30. Thus, the distance between the printing plate 1 and workpiece 30 can be ascertained.

In use, the plate holder 2 is rapidly lowered to a point approximately 200 microns above the detection point (i.e., a point approximately 150 microns above the Z level), and this point is designated as a "search level." After this, the plate holder 2 is lowered more slowly. These actions are stored beforehand in the main control circuit 41. By doing this, the lowering time can be shortened. The distance the plate holder 2 is lowered (i.e., the amount of pressing-in) is set beforehand in the main control circuit 41 with the output of the signal 6a as a criterion.

Printing operation will be described below.

When a "start" button (not shown) is pressed, the plate holder 2 is rapidly lowered to the search level located approximately 150 microns above the workpiece 30 from the starting position. Afterward, the plate holder 2 is lowered slowly. Then, the printing plate 1 comes into contact with the workpiece 30, after which the contact rod 6 is lowered in accordance with the lowering action of the contact rod 11 (while maintaining contact with the contact rod 11) until the printing plate 1 is compressed by a given amount of distance due to the weight of the elements 1 through 8.

After this, the plate holder attachment 4 is no longer lowered. Instead, the first moving table 9 alone is lowered, so that the contact rod 11 is separated from the contact rod 6, causing an "off" signal 6a to be outputted from the contact rod 6.

As a result of such a detection signal, the main control circuit 41 outputs a signal that causes the printing plate 1 to be lowered the pressing-in amount (which is stored beforehand in the main control circuit 41). As a result, the first moving table 9 is first lowered a distance which corresponds to the gap between the stopper 12 and the plate holder attachment 4, whereupon the stopper 12 contacts the plate holder attachment 4. Accordingly, when the first moving table 9 is further lowered from this position, the plate holder attachment 4 is pressed by the stopper 12, and the printing plate 1 is pressed against the workpiece 30. Printing is thus performed.

Since the Z-direction driving motor 18 is driven a predetermined distance by the main control circuit 41 via the Z-motor control circuit 42 in accordance with the signal 6a, printing is performed uniformly even though there are some thickness variations in the workpieces 30 since the pressing-in amount of distance from the top surface of the workpiece 30 is constant.

Figure 3:
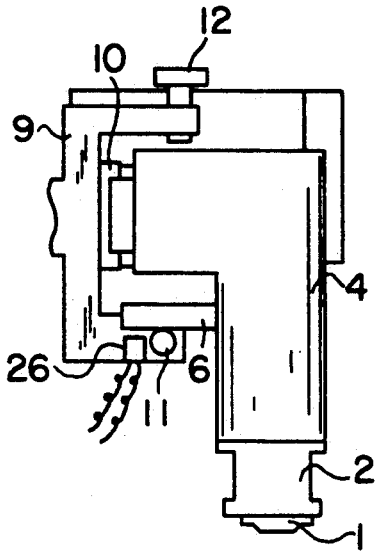
FIG. 3 is a front view which illustrates the essential portion of another embodiment of the present invention.
Figure 4:
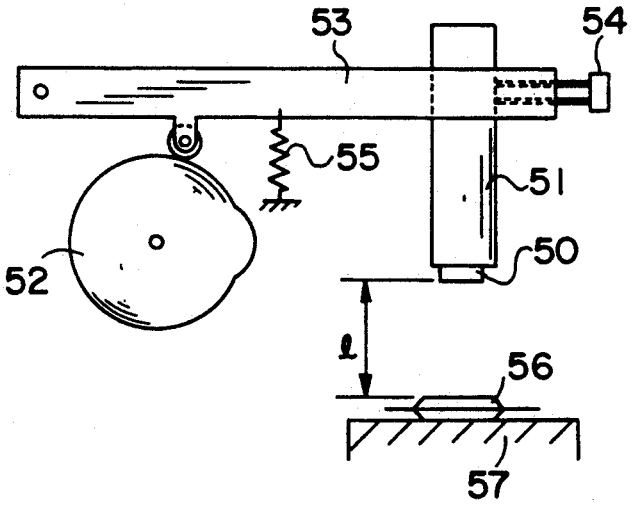
FIG. 4 (PRIOR ART)
FIG. 4 is a schematic explanatory diagram of a conventional device.

FIG. 3 illustrates another embodiment of the present invention. In the embodiment described above, the point of contact was detected by the on/off action of the contact rods 6 and 11. In the embodiment of FIG. 3, the contact rods 6 and 11 merely act as supporting rods, and a non-contact type sensor 26 is attached to the first moving table 9 with a predetermined gap maintained between the sensor 26 and the contact rod 6.

With such a structure, the contact point can be detected based upon changes in the distance between the sensor 26 and the contact rod 6.

The sensor 26 is not necessarily to face the contact rod 6; it would be possible to install the sensor 26 so that it faces an arbitrary position of the plate holder attachment 4.

In the present invention, as is clear from the above description, the distance between the printing plate and the surface of the workpiece can be calculated. Accordingly, even if the thickness of the workpieces are different, the distant the of time. Also, no variation occurs in the contact condition between the printing plate and the surface of the workpiece even if the printing plate is lowered manually. Accordingly uniform printing can be achieved.

In addition, the printing plate can be rapidly lowered to a position which is slightly above the position where the printing plate contacts the workpiece. Accordingly, productivity can be improved.

We claim:

1. A method of printing on workpieces of differing thicknesses comprising: attaching a printing plate to a plate holder, moving said plate holder up and down by means of a Z-direction driving motor from a start position, detecting with a detection means when the printing plate comes into contact with a workpiece, and lowering said plate holder rapidly from said start position to a position slightly above said detected position at which said printing plate contacts the workpiece, then slowly lowering said plate holder until said printing plate contacts said workpiece to perform printing on the workpiece, whereby uniform printing on said workpiece is achieved.

* * * * *